United States Patent [19]

Mengel et al.

[11] Patent Number: 4,600,160

[45] Date of Patent: Jul. 15, 1986

[54] CHOPPER BLADE ASSEMBLY

[75] Inventors: Ronald E. Mengel, Madison; Thomas E. Seipel, Sun Prairie, both of Wis.

[73] Assignee: Oscar Mayer Foods Corporation, Madison, Wis.

[21] Appl. No.: 652,687

[22] Filed: Sep. 20, 1984

[51] Int. Cl.[4] ..... B02C 18/18

[52] U.S. Cl. ..... 241/282.2; 241/194

[58] Field of Search ..... 426/518; 241/194, 195, 241/282.1, 282.2

[56] References Cited

U.S. PATENT DOCUMENTS

| | | | |
|---|---|---|---|
| 3,030,993 | 4/1962 | Schmook, Jr. | 241/194 X |
| 3,098,613 | 7/1963 | Hellyer | 241/194 X |
| 4,136,833 | 1/1979 | Knight | 241/194 |

*Primary Examiner*—Mark Rosenbaum

*Attorney, Agent, or Firm*—Joseph T. Harcarik; Thomas R. Savoie; Daniel J. Donovan

[57] ABSTRACT

A continuous chopper assembly including a housing having received therein a rotatable shaft, a plurality of blade members, means for mounting said blade members on said shaft for rotation therewith, inlet means in said housing for the delivery of material thereinto for comminution by said blade members, and drive means for rotating said shaft. Said blade members each include a curved cutting edge and a further abutment edge, wherein said mounting means for each blade member includes a pivot member for providing of the corresponding blade member about a pivot axis remote from said curved cutting edge during the rotation of said shaft. Said assembly further includes a stop member for each blade member mounted on said mounting means downstream for the corresponding pivot member in the direction of rotation of the blade members and positioned in the path of travel of the abutment edge of the corresponding blade member such that said corresponding blade member engages said stop member, during rotation of said drive shaft.

7 Claims, 3 Drawing Figures

CHOPPER BLADE ASSEMBLY

FIELD OF THE INVENTION

The present invention relates to material comminuting devices and more specifically to comminuting devices of the type which are referred to as continuous choppers and which are particularly adapted for use in the comminution of meat in the manufacture of sausage-type products.

BACKGROUND OF THE INVENTION

The blades of chopper device of the type referred to above rotate with the associated rotor assembly at high speed within a cylindrical housing so that the cutting edges thereof come into close proximity to the inner surface of the housing to chop or comminute meat, or other product being chopped, as the product passes through the housing. In the course of normal operations, the cutting edges of the blades become dull and in time require sharpening. However, repeated sharpening of the blades results in removal of metal from the cutting edges and and noticeably increases the normal small spacing or clearance between the cutting edges of the blades and the inner surface of the cylindrical housing, thereby preventing proper comminution of the meat or other product. It has therefore been necessary with some chopper devices to frequently replace the blades even though the blades still include ample blade material for sharpening. Considering the large number of blades in a chopper, the cost of frequent replaclement is considerable. An example of an arrangement of this type is that disclosed in U.S. Pat. No. 2,742,937 (Herzer).

To overcome these problems, improved chopper blades have been provided which are pivotably connected to the rotor in a manner such that the cutting edges thereof are centrifugally urged into close proximity to the inner surface of the cylindrical housing or bowl and wherein a stop pin is provided on the blades to ensure maintenance of a desired clearance between the cutting edges and the inner surface of the housing. A major advantage of this arrangement is that the blades can be sharpened although, as noted below, some reshaping of the blade is required when the blade is sharpened to maintain the desired clearance. Examples of such blade arrangements are disclosed in U.S. Pat. Nos. 3,030,993 (Schmook, Jr.); 3,215,535 (Schomook, Jr. et al), the disclosures of which are hereby incorporated by reference.

The chopper blades disclosed in these patents are pivoted at one inner ede and the stop referred to comprises a fixed pin or projection which is received in a recess or slot in the other inner edge of the blade, the recess forming a "ledge" or "heel" at one corner of the base of the blade. This "ledge" constitutes a projection or shoulder which engages the stop pin when the blade is pivoted and thus limits the pivoting movement of the blade so that the desired clearance is maintained.

While this arrangement provides marked advantages over the prior art and is more than adequate for its intended purposes, the arrangement suffers certain drawbacks. More specifically, the "heel" of the blades of such prior art devices is subject to breakage. This tendency to break increases as the blade is removed from time to time in the routine sharpening procedure referred to above, in that it is necessary to remove a small part of the blade in the portion of the heel which engages the stop pin so as to permit the blade to remain close to the wall of the bowl during the operation of the device and thus provide the appropriate comminuting action. This removal of material weakens the blade in an area where the blade is already weakest and thus increases the the chances of breakage.

Other patents which disclose devices which may be of possible interest insofar as the present invention is concerned include U.S. Pat. Nos. 14,926 (Plaisted), directed to a rotary hammer; 2,536,929 (Hammell), directed to a garbage grinder; 2,656,985 (Backlund et al), directed to a garbage disposal apparatus; and 2,822,138 (Oliver), directed to an impact crusher. The rotary hammer of the Plaisted patent includes blades which are attached to a hub and which each include a radial end having a flat surface that contacts an adjacent flat surface of the hub. During rotation of the hub, the blade pivots outwardly until the flat surface contact each other. In the impact crusher of the Oliver patent, hammers are pivotedly connected to a certral hub and swing outwardly from hub until a stop extending from the hammer contacts an abutment on the hub. The grinder of the Hammell and Backlund et at patents include hammers which swing to a substantially straight our (radial) position.

SUMMARY OF THE INVENTION

In accordance with the invention, an improved chopper blade assembly is provided which affords a number of important advantages over the prior art. The chopper blades are mounted on a mounting ring or arbor and the geometry of the blades is such as to provide the required cutting action when the blades are rotated at high speed. This high speed rotation causes the blades to pivot out to the cutting positions thereof, with the extent of pivoting of the blades being limited by a stop member on the arbor. As will appear, the shape of the blade members, the location of the pivot axes of the blade members and the positioning of the stop members combine to provide a number of advantages including a reduction in manufacturing costs, an increase in the potential for more sharpenings, a reduction in breakage and a significant decrease in the actual number of blades required at the same throughput for the same temperature rise. Regarding the reduction in breakage, the "heel" or "ledge" of prior art designs has been eliminated, the blade of the invention having a simple geometrical shape without any recesses or the like therein. Thus, when the blade is sharpened, this simple geometry permits the removal of material from the blade to maintain the desired wall clearance without weakening the blade. Further, the stop or limit member is located at a different location in the device of the present invention, downstream of the pivot axis in the direction of rotation, so that the corresponding blade member is put into compression, rather than in tension as in the devices of U.S. Pat. No. 3,030,993 (Schmook, Jr.) and the related patents referred to above.

Thus, in accordance with the invention, a continuous chopper assembly is provided which includes a housing having received therein a rotatable shaft, a plurality of blade members, means for mounting the blade members on the shaft for rotation therewith, inlet means in the housing for the delivery of material thereinto for comminution by the blade members, and drive means for rotating the shaft, the invention concerning an improvement wherein the blade members each include a curved cutting edge and a further object edge, wherein the mounting means for each blade member includes a pivot member for providing pivoting of the corresponding blade member about a pivot axis remote from the curved cutting edge during rotation of the shaft, and wherein the assembly further includes a stop member for each blade member mounted on the mounting means downstream of the corresponding pivot member in the direction of rotation of the blade members and positioned in the path of travel of the abutment edge of the corresponding blade member and is put into compression thereby in the area of the stop member, during rotation of the drive shaft.

Preferably, the abutment edge is substantially straight and material is removed therefrom to provide the appropriate compensation for wall clearance during sharpening. In a preferred embodiment, each blade member has three major sides comprising the curved cutting edge, the abutment edge and a furtheredge, with the abutment edge being shorter than the further edge. Advantageously, the further edge is also substantially straight and the curved edge is substantially arcuate. Preferably, the mounting means includes a mounting ring, the pivot member comprises a pivot pin mounted on the mounting ring, and the stop member comprises a stop pin mounted on the mounting ring in spaced, downstream relation to the pivot pin so as to engage the abutment edge near the middle thereof.

Other features and advantages of the invention will be set forth in, or apparent form, the detailed description of a preferred embodiment which follows.

DESCRIPTION OF THE PREFERRED EMBODIMENTS

Figure 1:
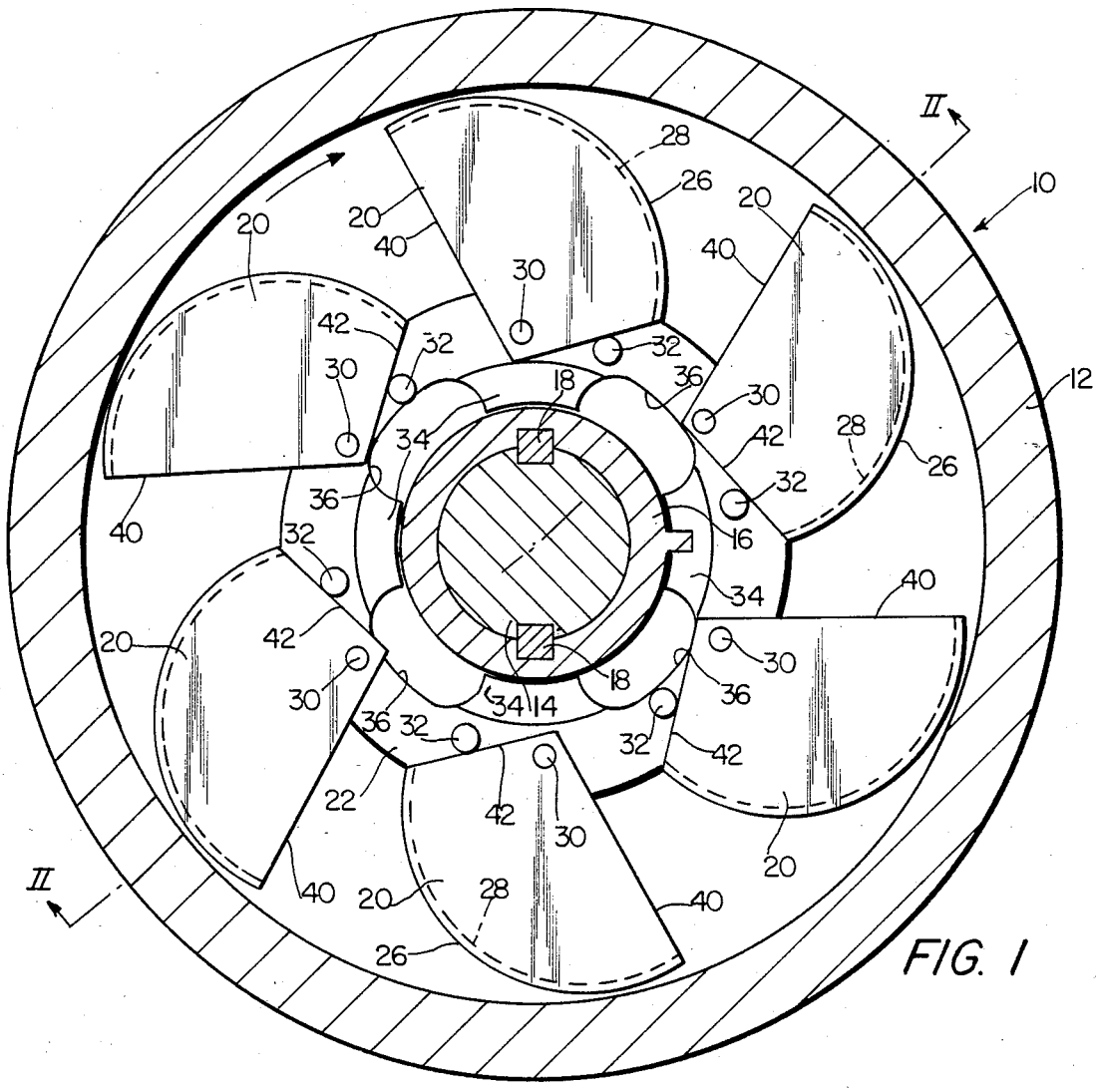
FIG. 1 is a horizontal sectional view taken generally along line 1—1 of FIG. 2, of a chopper assembly incorporating the invention, with the circumferentially spaced series of blades below the uppermost series of blades removed for purposes of clarity.
Figure 2:
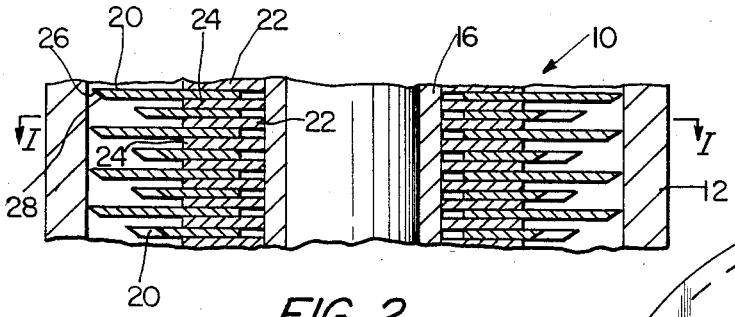
FIG. 2 is a fragmentary vertical sectional view taken generally along line 11—11 of FIG. 1.

Refferring particularly to FIGS. 1 and 2, a continuous chopper assembly is shown which is constructed in accordance with a preferred embodiment of the invention. As discusses above, the overall chopper assembly is similar to that described in U.S. Pat. No. 3,030,993 (Schmook, Jr.), among others. The chopper assembly, which is generally denoted 10, includes a cylindrical housing 12 and a concentrically arranged shaft 14 which is adapted to be driven at high rates of speed by a suitable power source (not shown). Preferably, the assembly 10 is arranged for vertical operation, as illustrated, and suitable mounting members (not Shown) may be provided on the outside of the housing 12. A sleeve 16 is secured on the shaft 14 by keys 18 for rotation therewith.

A plurality of chopper or cutting blade members 20 are mounted within the chopper housing 12 on a series of blade mounting rings 22 which are fitted over and keyed to the sleeve 16. The rings 22 are separated by a series of ring spacers 24 (see FIG. 2). The shaft 14, the sleeve 16, the rings 22, and the spacers 24 are referred to hereinafter as a rotor assembly.

Figure 3:
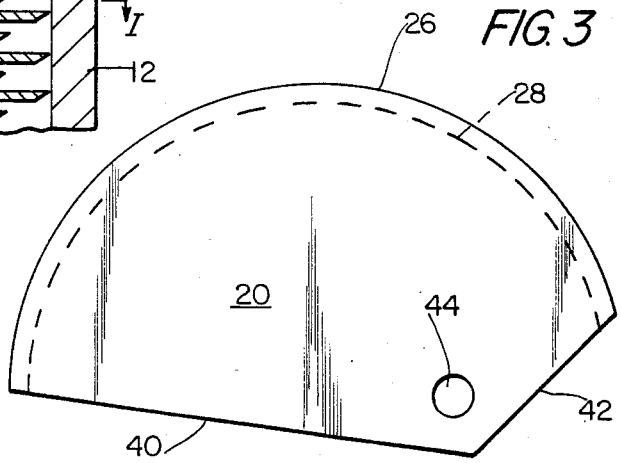
FIG. 3 is a plan view of a blade member embodying the invention.

As shown in FIGS. 1 and 3, each blade member 20 is shaped generally like a sector or quadrant with the arcuate edge thereof being sharpened to provide a cutting edge 26 having a bevel 28 on the underside thereof. Each blade mounting ring 22 carries thereon a series of circumferentially spaced blades or knife members 20 each of which is attached by a pair of circumferentially spaced dowel-like pins 30. As described in more detail below, each blade member 20 is pivotably mounted on its mounting ring 22 in a manner such that, during high speed rotation of the shaft 14, the blade members 20 are pivoted outwardly by centrifugal force against corresponding stop members or pins 32 mounted on mounting rings 22 whereby portions of the cutting edges 26 of the blade member 20 on opposite sides thereof as illustrated in FIG. 2, with alternate series of blade members 20 being circumferentially staggered. The spacers 24 are suitably designed to provide for adequate spacing between the blade mounting rings 22 and the blade members 20 carried thereby, with pin receiving apertures therein (not Shown) to interlock the rotor assembly and prevent relative movement therebetween.

The specific embodiment illustrated in FIGS. 1 and 2 has additional features in common with the chopper blade assembly disclosed in U.S. Pat. No. 3,030,993 (Schmook, Jr. et al) including axially directed passages or ports 36, defined by inwardly directed flange-like portions 34 of the rings 22 and spacers 24, for permitting removal of oxygen bearing air from the material comminuted. Flanges 34 which are part of rings 22 are keyed to sleeve 16 as shown in FIG. 1. Such features do not form part of the present invention and reference is made to that patent for a further description of the details of a chopper blade assembly of this general type.

The general operation of the chopper assembly 10 is also similar to that of U.S. Pat. No. 3,030,993, except for the important differences discussed below. Considering this overall operation, feed material, such a relatively small chunks of meat which, if desired, may be mixed with sausage batter ingredients, is delivered into the housing 12 through an inlet (not shown). The blade members 20 are rotated at relatively high speeds as, for example, within the range of 3,000 to 4,5000 r.p.m., operation at these speeds providing adequate centrifugal force to provide for an accumulation of meat along the inner surface of the housing 12 to define a continuously moving meat sleeve. The meat is thus placed in contact with the cutting edges 26 of the blade members 20, these cutting edges being rotatable, as mentioned above, in close proximity to the inner surface of the housing 12. The thickness of the sleeve-like accumulation of meat may vary in width within small limits and the cutting edge 26 of each blade member 20 continuously moves through the accumulation to provide relatively fine comminution thereof. The substantial centrifugal force developed by the high speed rotation of the blade members 20 will maintain the meat particles against the inner surface of the housing 12 and the bevels 28 formed on the bottom edges of the blade members 20 will provide for continuous movement of the accumulated meat particles downwardly along the inner surface of the housing 12 toward the discharge end of the chopper assembly 10.

After long and continuous operation of the chopper assembly 10, the cutting edges 26 of the blade members 20 tend to become dulled. The blade members 20 and the mounting thereof, permits sharpening of the dulled cutting edges 26 without effecting or increasing the close spacing or clearance between the cutting edges 26 and the inner surface of the cylindrical housing 12. This clearance should, of course, be retained to provide the desired fineness of comminution of the product passed through the housing 12. It should be pointed out that this basic effect is also produced with the blade arrangement of the aforementioned Schmook, Jr. patent and related patents but that the same operation is accomplished by the blade arrangement of the invention with certain important advantages which were mentioned above and which are discussed below.

In contrast to the choper blade assembly described in the aforementioned patents, the blades 20 of the invention do not include a "heel" or "ledge" portion. As shown in FIG. 3 (and FIG. 1), the shape of each blade 20 is defined by arcuate cutting edge 26, and a pair of simple straight edges 40 and 42 which intersect to form the generally sector or quadrant shape referred to above. A pivot aperture or hole 44 for receiving a pivot pin 30 is located near the intersection of straight edges 40 and 42, as illustrated in FIG. 3. The stop pins 32 are positioned to engage the short straight edge 42, also referred to as an abutment edge, when the blades are piovted outwardly by centrifugal force during the rotation of the drive shaft 14. In contrast to blades of the aforementioned patents wherein a "heel" or projection is provided on each cutting blade and is engaged by, and provided tensioning of, that blade, the abutment edges 42 of the blades 20 are pivoted into direct engagement with corresponding stop pins 32 and are compressed thereby in the area of these pins, when shaft 14 rotated in a clockwise direction as indicated by the arrow in FIG. 1.

Returning again to the problem of blade sharpening, with the blade of the aforementioned Schmook, Jr. patent and related patents it is necessary after sharpening the cutting edge (corresponding to edge 26) to remove material from the blade in the area of the "ledge" or "heel" in order that the cutting edge remains close to the chopper "bowl" or housing. As discussed above, this weakens the "heel" and the problem becomes greater as more and more of the blade material is removed. With the blade of the invention, when the edge 26 is sharpened, this can be compensated for by suitably grinding down the abutment edge 42 so that cutting edge 26 assumes its proper portion in relation to housing 12 during rotation of shaft 14. It will be appreciated that this will not weaken the blade, as does cutting away the blade in the area of the heel in the blade assemblies of the patents discussed above.

It will be appreciated that with the blade assembly of the invention the center of gravity of the blade is shifted relative to the blades discussed previously and, as stated, the blade is compressed by the stop pin rather than tensioned. It is noted that it has been found that the number of blades required can be significantly reduced at the same throughput and it will be appreciated that this is very important improvement given the large number of these very expensive blades that are required under normal operating conditions. For example it has been found that the number of blades can be reduced from 120 blades per device to 100 blades per device with the same throughput. In one embodiment the number of blades are reduced by removing two blades from ten planes of blades. Thus ten planes, perferably the middle planes, have four blades per plane and ten planes, preferably the top and bottom planes have 6 blades per plane for a total of 100 blades.

The blade of the invention is also less expensive to make than previous blades and, as discussed, has the potential for more sharpenings.

Although the invention has been described relative to a preferred embodiment thereof, it will be appreciated by those skilled in the art that variations and modifications can be effected in this exemplary embodiment without departing from the scope and spirit of the invention.

We claim:

1. In a continuous chopper assembly including a housing having received therein a rotatable shaft, a plurality of blade members, means for mounting said blade members on said shaft for rotation therewith, inlet means in said housing for the delivery of material thereinto for comminution by said blade members, and drive means for rotating said shaft, the improvement, wherein each said blade members has three major sides comprising a substantially accurate curved cutting edge, an abutment edge and further edge intersecting said abutment edge, said abutment edge being shorter than said further edge, wherein said mounting means for each blade member includes a pivot member for providing of the corresponding blade member about a pivot axis remote from said curved cutting edge and being located in proximity to the intersection between the abutment edge and the further edge during the rotation of said shaft and wherein said assembly further includes a stop member for each blade member mounted on said mounting means downstream of the corresponding pivot member in the direction of rotation of the blade members and positioned in the path of travel of the abutment edge of the corresponding blade member such that said corresponding blade member engages said stop member, during rotation of said drive shaft.

2. A chopper assembly as claimed in claim 1 wherein said abutment edge is substantially straight.

3. A chopper assembly as claimed in claim 1 wherein and said abutment edge and said further edge are substantially straight.

4. A chopper assembly as claimed in claim 1 wherein said blade members are each substantially sector shaped, and said abutment edge is substantially straight.

5. A chopper assembly as claimed in claim 4 wherein said pivot member is disposed in proximity to the end of the abutment edge remote from the curved cutting edge.

6. A chopper assembly as claimed in claim 1 wherein said stop member comprises a stop pin mounted downstream of said pivot member in the direction of rotation of said blade members and disposed so as to engage said abutment edge intermediate the ends of the abutment edge.

7. A chopper assembly as claimed in claim 1 wherein said mounting means includes a mounting ring, wherein said pivot member comprises a pivot pin mounted on said mounting ring, and wherein said stop member comprising a stop pin mounted on said mounted ring in spaced, downstream relation to said pivot pin.

* * * * *